US008556148B2

(12) United States Patent
Schell et al.

(10) Patent No.: US 8,556,148 B2
(45) Date of Patent: Oct. 15, 2013

(54) FASTENER TOOL

(75) Inventors: Craig A. Schell, Baltimore, MD (US); Ashok S. Baskar, Owings Mills, MD (US); Keven E. Miller, Wyoming, RI (US); Thomas E. Miller, Spring Grove, PA (US); Charles R. Frohlich, III, Columbia, MD (US); John E. Buck, Cockeysville, MD (US); Andrzej R. Wojcicki, Rosedale, MD (US); Glen V. Steinbrunner, Forest Hill, MD (US)

(73) Assignee: Black & Decker Inc., Newark, DE (US)

( * ) Notice: Subject to any disclaimer, the term of this patent is extended or adjusted under 35 U.S.C. 154(b) by 971 days.

(21) Appl. No.: 11/941,487

(22) Filed: Nov. 16, 2007
(Under 37 CFR 1.47)

(65) Prior Publication Data

US 2008/0290129 A1 Nov. 27, 2008

Related U.S. Application Data

(63) Continuation-in-part of application No. 11/169,264, filed on Jun. 27, 2005, now Pat. No. 7,320,422, and a continuation of application No. 10/057,476, filed on Jan. 24, 2002, now abandoned.

(51) Int. Cl.
*B25C 1/04* (2006.01)

(52) U.S. Cl.
USPC ..... 227/123; 227/8

(58) Field of Classification Search
USPC ..... 227/123, 120, 8, 129
See application file for complete search history.

(56) References Cited

U.S. PATENT DOCUMENTS

| | | | | |
|---|---|---|---|---|
| 3,615,049 | A | | 10/1971 | Obergfell et al. |
| 4,436,236 | A | * | 3/1984 | Jobe ..... 227/123 |
| 4,467,952 | A | * | 8/1984 | Morrell, Jr. ..... 227/123 |
| 4,570,841 | A | * | 2/1986 | Olesen ..... 227/95 |
| 4,787,145 | A | | 11/1988 | Klicker et al. |
| 4,913,332 | A | | 4/1990 | Olesen |
| 5,335,800 | A | | 8/1994 | Liu |
| 5,433,367 | A | | 7/1995 | Liu |
| 5,803,338 | A | | 9/1998 | Singer |

(Continued)

FOREIGN PATENT DOCUMENTS

| | | | |
|---|---|---|---|
| DE | 3715293 | A1 | 12/1988 |
| DE | 8914148 | U1 | 1/1990 |
| DE | 19856266 | A1 | 6/2000 |
| GB | 2116897 | A | 10/1983 |

OTHER PUBLICATIONS

Search Report—European Patent Office for related application EP02250836.

(Continued)

*Primary Examiner* — Scott A. Smith
(74) *Attorney, Agent, or Firm* — Rhonda L. Barton

(57) ABSTRACT

A fastener tool includes a housing comprising a nosepiece and a magazine connected to the housing for storing a fastener. A driving mechanism is disposed within the housing for driving the fastener into a workpiece. A trigger assembly is pivotally attached to the housing for activating the driving mechanism. A nosepiece cover is pivotally attached to the nosepiece. A latch is pivotally attached to the nosepiece cover. A latch wire is pivotally attached to the latch for engaging at least one hook disposed on the nosepiece. The latch wire has a portion extending between the latch and the hook, the portion having at least two bends.

15 Claims, 11 Drawing Sheets

(56) References Cited

U.S. PATENT DOCUMENTS

| | | | | |
|---|---|---|---|---|
| 5,813,588 | A | 9/1998 | Lin | |
| 6,010,103 | A | 1/2000 | Ashworth | |
| 6,056,182 | A | 5/2000 | Chen | |
| 6,318,618 | B1 * | 11/2001 | Jen | 227/123 |
| 6,325,268 | B1 * | 12/2001 | Liang | 227/123 |
| 6,763,989 | B2 * | 7/2004 | Wang | 227/123 |
| 7,032,796 | B1 * | 4/2006 | Lin | 227/123 |

OTHER PUBLICATIONS

Matzdorf, Udo—Search Report for corresponding application No. EP09163587.0/1262—Jul. 24, 2009—The Hague.

Matzdorf, Udo—European Search Report re European Patent Application No. 10186081.5—Mar. 18, 2011—The Hague.

Matzdorf, Udo—European Search Report re European Patent Application No. 10186078.1—Mar. 17, 2011—The Hague.

Matzdorf, Udo—European Search Report re European Patent Application No. 10186082.3—Mar. 18, 2011—The Hague.

Matzdorf, Udo—European Search Report re European Patent Application No. 10186084.9—Mar. 18, 2011—The Hague.

Matzdorf, Udo—European Search Report re European Patent Application No. 10186075.7—Mar. 21, 2011—The Hague.

* cited by examiner

FASTENER TOOL

CROSS REFERENCE TO RELATED APPLICATIONS

This application is a continuation-in-part of U.S. patent application Ser. No. 11/169,264, flied Jun. 27, 2005, now U.S. Pat. No. 7,320,422, which is a continuation of U.S. patent application Ser. No. 10/057,476, filed Jan. 24, 2002, now abandoned, which claims priority under 35 U.S.C. §119 (e) to U.S. Provisional Application No. 60/266,893, filed Feb. 7, 2001, each of which is incorporated herein by reference.

TECHNICAL FIELD

This application relates to a powered fastener tool, e.g., a fastener tool powered by pneumatic, electric, mechanical and/or combustion energy.

BACKGROUND

A powered fastener tool may be used for driving fasteners, e.g., nails or staples, into workpieces. A fastener tool may include a housing, a handle extending from the housing, a nosepiece coupled to the housing, a trigger for actuating the fastener tool, and a magazine for holding one or more fasteners. The housing may house a driving mechanism used to drive the fastener from the nosepiece into a workpiece. The driving mechanism may be powered by pneumatic, electrical, mechanical, and/or combustion energy.

SUMMARY

In an aspect, a fastener tool includes a housing comprising a nosepiece; a magazine connected to the housing for storing a fastener; a driving mechanism disposed within the housing for driving the fastener into a workpiece; a trigger assembly pivotally attached to the housing for activating the driving mechanism; a nosepiece cover pivotally attached to the nosepiece; a latch pivotally attached to the nosepiece cover; and a latch wire pivotally attached to the latch for engaging at least one hook disposed on the nosepiece. The latch wire has a portion extending between the latch and the hook, the portion having at least two bends.

Implementations of this aspect may include one or more of the following features. The nosepiece has a cutout for allowing at least one of the two bends to extend below the top surface of the nosepiece cover. The at least two bends in the latch wire for a substantially S-shape. The latch wire has a first and second legs extending along a longitudinal axis of the nosepiece and a cross bar connecting the first and second legs and extending across the nosepiece cover. Each of the first and second legs has at least two bends. Each of the first and second legs has an S-shape. The cross bar comprises a third bend. The latch wire comprises at least a third bend. The nosepiece cover has a ramped surface that opposes an inner surface of the hook, where the latch wire is cammed by the ramped surface toward the inner surface of the hook when the latch is closed.

In another aspect, a fastener tool includes a housing having a nosepiece; a magazine connected to the housing for storing a fastener; a driving mechanism disposed within the housing for driving the fastener into a workpiece; a trigger attached to the housing for activating the driving mechanism; a nosepiece cover pivotally attached to the nosepiece; a latch pivotally attached to the nosepiece cover; and a spring pivotally attached to the latch for engaging at least one hook disposed on the nosepiece. The spring has first and second legs extending along a longitudinal axis of the nosepiece and a cross-bar connecting the legs and extending across the nosepiece, each of the first and second legs having at least two bends.

Implementations of this aspect may include one or more of the following features. Each of the first and second legs has an S-shape. The nosepiece has a cutout for allowing at least one of the two bends to extend below the top surface of the nosepiece cover. The cross-bar has a bend. The nosepiece cover has a ramped surface that opposes an inner surface of the hook, where the cross-bar is cammed by the ramped surface toward the inner surface of the hook when the latch is closed. The ramped surface is at an angle between approximately 5 degrees and approximately 30 degrees relative to the nosepiece cover.

In another aspect, a fastener tool has a housing comprising a nosepiece; a magazine connected to the housing for storing a fastener; a driving mechanism disposed within the housing for driving the fastener into a workpiece; a trigger assembly pivotally attached to the housing for activating the driving mechanism; and a nosepiece cover pivotally attached to the nosepiece. One of the nosepiece and the nosepiece cover have a protrusion contacting the other of the nosepiece and the nosepiece cover upon rotation of the nosepiece cover for limiting rotational motion range of the nosepiece cover relative to the nosepiece.

In another aspect, a fastener tool includes a nosepiece and a magazine connected to the nosepiece for storing a fastener. The magazine has top, side and bottom walls, a fastener loading space disposed between the top and bottom walls, a door movable between the top and bottom walls, and a pusher disposed in the fastener loading space for pushing the fastener towards the nosepiece. A driving mechanism is disposed within the housing for driving the fastener into a workpiece. A trigger assembly pivotally attaches to the housing for activating the driving mechanism. The top wall of the magazine has a window disposed near the nosepiece for showing when a low number of fasteners remains in the magazine.

Implementations of this aspect may include one or more of the following features. The pusher has a colored portion that is visible through the window when a low number of fasteners remains in the magazine. A pin is disposed on the magazine for stopping the pusher from entering into the nosepiece. The pin is disposed on the door. A window is disposed on the door near the nosepiece for showing when a low number of fasteners remains in the magazine. The pusher has a colored portion that is visible through the window when a low number of fasteners remains in the magazine.

In another aspect, a fastener tool has a housing having a nosepiece and a magazine connected to the nosepiece for storing a fastener. The magazine has top, side and bottom walls, a fastener loading space disposed between the top and bottom walls, a door movable between the top and bottom walls, and a pusher disposed in the fastener loading space for pushing the fastener towards the nosepiece. A driving mechanism is disposed within the housing for driving the fastener into a workpiece. A trigger assembly is pivotally attached to the housing for activating the driving mechanism. The door has a window disposed near the nosepiece for showing when a low number of fasteners remains in the magazine.

Implementations of this aspect may include one or more of the following features. The pusher has a colored portion that is visible through the window when a low number of fasteners remains in the magazine. A pin is disposed on the magazine for stopping the pusher from entering into the nosepiece. The pin is disposed on the door. A window is disposed on the top wall of the magazine near the nosepiece for showing when a low number of fasteners remains in the magazine. The pusher has a colored portion that is visible through the window when a low number of fasteners remains in the magazine.

In another aspect, a fastener tool includes a housing having a nosepiece and a handle. A magazine assembly is connected to the housing for storing a fastener. The magazine assembly has an upper magazine with a rail for receiving a fastener head, a lower magazine fixedly attached to the upper magazine, the lower magazine defining a fastener channel and a pusher channel, and a pusher assembly for pushing the fastener towards the nosepiece. The pusher has a carriage which slides along the rail, a pin extending from the carriage extending into the pusher channel, an upper pusher pivotally attached to the pin, the upper pusher having a tab which can be moved by a user, a lower pusher pivotally attached to the pin, the lower pusher having a contact surface for contacting the fastener and pushing the fastener towards the nosepiece, and a spring for biasing the upper and lower pushers towards the fastener channel. A driving mechanism is disposed within the housing for driving the fastener into a workpiece. A trigger assembly is pivotally attached to the housing for activating the driving mechanism. The lower pusher has a camming surface to bypass fasteners inserted into the magazine assembly when the pusher assembly is moved towards the end of the magazine assembly farthest from the nosepiece. The upper magazine has at least one indentation near the end of the magazine assembly farthest from the nosepiece for latching the upper pusher.

Implementations of this aspect may include one or more of the following features. The magazine assembly has a retainer disposed near the end of the magazine assembly farthest from the nosepiece for retaining fasteners within the magazine assembly. The retainer extends into the fastener channel. The retainer has a camming surface which moves the retainer out of the fastener channel when fasteners are inserted into the magazine assembly. The retainer is made of a resilient material. The retainer is made of metal.

In another aspect, a method for using a fastener tool with a magazine assembly, includes the steps of: providing a pusher assembly in the magazine assembly that can bypass fasteners inserted into the magazine assembly and that can be releasably locked at the rear end of the magazine assembly; in a first mode of operation, inserting fasteners into the magazine assembly, and moving the pusher assembly towards the rear end of the magazine assembly; and in a second mode of operation, moving the pusher assembly towards the rear end of the magazine assembly, locking the pusher assembly at the rear end of the magazine assembly, inserting fasteners into the magazine assembly, and releasing the pusher assembly.

In another aspect, a fastener tool includes a housing having a nosepiece and a handle. A magazine assembly is connected to the housing for storing a fastener. The magazine assembly has a magazine defining a fastener channel and a pusher channel, and a pusher assembly for pushing the fastener towards the nosepiece. The pusher assembly slides along the pusher channel and includes a pusher for contacting the fastener and pushing the fastener towards the nosepiece, and a spring for biasing the pusher towards the fastener channel. A driving mechanism is disposed within the housing for driving the fastener into a workpiece. A trigger assembly is pivotally attached to the housing for activating the driving mechanism. The pusher has a camming surface to bypass fasteners inserted into the magazine assembly when the pusher assembly is moved towards the end of the magazine assembly farthest from the nosepiece. The magazine has at least one indentation near the end of the magazine assembly farthest from the nosepiece for latching the pusher.

In another aspect. a power tool includes a working portion configured to be applied to a workpiece and a housing coupled to the working portion. The housing includes a driving mechanism for driving the working portion to perform an operation to a workpiece. A extends from the housing and has first and second portions. A switch is coupled to at least one of the housing and the handle for activating the driving mechanism. A hook assembly has a annular member rotationally disposed between the first and second portions of the handle, and a hook portion extending from the annular member. The annular member has a first positive stopping element that engages a second positive stopping element on one of the first and second portions of the handle.

Implementations of this aspect may include one or more of the following features. The hook portion extends substantially parallel to a longitudinal axis of the handle. The hook portion comprises wire. The annular member is rotatable about a longitudinal axis of the handle. The first portion includes a grip portion configured to be gripped by a user and the second portion comprises an end cap. The first positive stopping element comprises one of a detent and a notch, and the second positive stopping element comprises the other of the detent and the notch. The first and positive locking elements are disposed a direction substantially parallel to a longitudinal axis of the handle. The first and positive locking elements are disposed a direction substantially transverse to a longitudinal axis of the handle. The handle further includes a ring that includes the second positive locking element, the ring abutting against the annular member and being clamped between the first and second portions of the handle. The annular member is disposed around a periphery of the handle. A driver blade drives a fastener out of the working portion and into the workpiece.

In another aspect, a handle for a power tool that includes a working portion configured to be applied to a workpiece, and a housing coupled to the working portion and including a driving mechanism for driving the working portion to perform an operation to a workpiece, and a switch coupled to at least one of the housing and the handle for activating the driving mechanism, includes a grip portion extending from the housing and an end cap configured to be coupled to the grip portion. An annular member is rotatably attachable to the handle with the annular member disposed between the grip portion and the end cap. A hook extends from the annular member. The annular member has a first positive locking element and one of the grip portion and the end cap has a second positive locking element that engages the first positive locking element. The hook extends substantially parallel to a longitudinal axis of the handle. The annular member is rotatable about the longitudinal axis. The first positive stopping element comprises one of a detent and a notch, and the second positive stopping element comprises the other of the detent and the notch. The handle further comprises a ring that includes the second positive locking element, the ring abutting against the annular member and being clamped between the first and second portions of the handle. The annular member is disposed around a periphery of the handle.

Other advantages and features will be apparent from the description, the drawings, and the claims.

BRIEF DESCRIPTION OF THE DRAWINGS

FIG. 2 is a partial cross-sectional view of a first trigger assembly, where

FIG. 4 illustrates an embodiment of a trigger lock according to the invention, where

FIG. 5 shows a prior art nosepiece assembly, where

FIG. 15 shows a second embodiment of a nosepiece assembly according to the invention, where

FIG. 16 shows another embodiment of a nosepiece assembly according to the invention, where

FIG. 20 illustrates a low nail indicator, where

FIG. 28 is another embodiment of the belt hook assembly according to the invention, where

DETAILED DESCRIPTION

Figure 1:
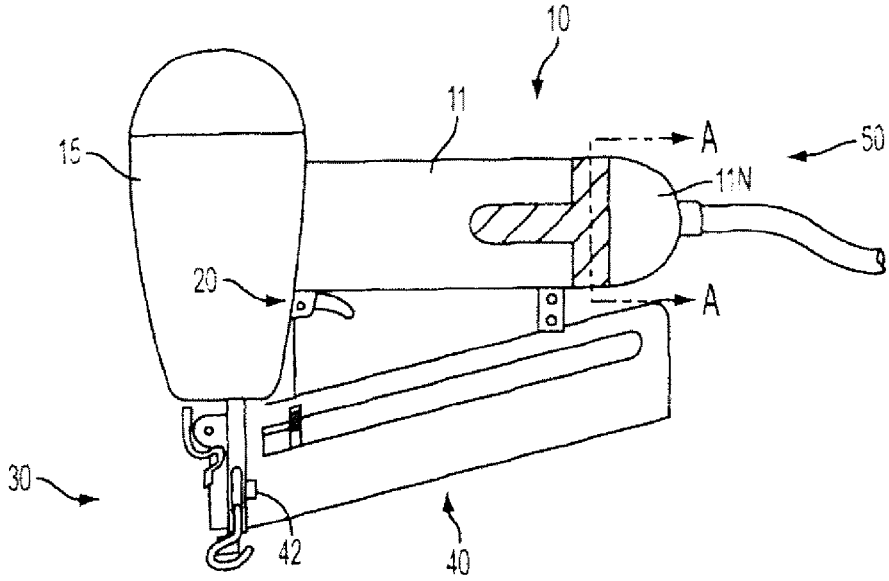
FIG. 1 is a side view of a fastener tool.

FIG. 1 shows a fastener tool 10 comprising a main housing 15 which covers the driving mechanism (not shown) for driving a fastener, such as a nail or a staple, and which includes a handle 11. The fastener tool 10 also comprises a nosepiece assembly 30 below the housing 15, a magazine assembly 40 connected to the nosepiece assembly 30 and the handle 11, and a trigger assembly 20 disposed on the housing 15 and/or handle 11 for activating the driving mechanism. Persons skilled in the art should recognize that the driving mechanism can be a pneumatic-based system, such as the ones shown in U.S. Pat. No. 3,673,922 or U.S. Pat. No. 5,181,450, an electric system, such as the ones shown in U.S. Pat. No. 4,928,868, a mechanical system, or a combustion system. The teachings from the aforementioned patents are wholly incorporated herein by reference.

Referring to FIGS. 1 and 2, the trigger assembly 20 may have a main trigger 21 pivotally attached to the housing 15 or handle 11 via pin 15P, and a supplemental trigger 22 pivotally attached to the main trigger 21 via pin 21P. As discussed below, when main trigger 21 and contact trip 23 are activated, supplemental trigger 22 will move valve 24, thus activating the driving mechanism. Persons skilled in the art will recognize that valve 24 will be a switch if the driving mechanism is an electric system, or an air flow-control valve if the driving mechanism is pneumatic system.

Figure 2A:
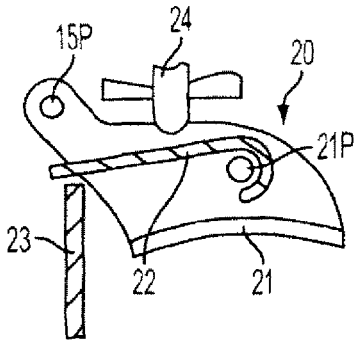
FIGS. 2A, 2B and 2C show different states of the triggering sequence.
Figure 2B:
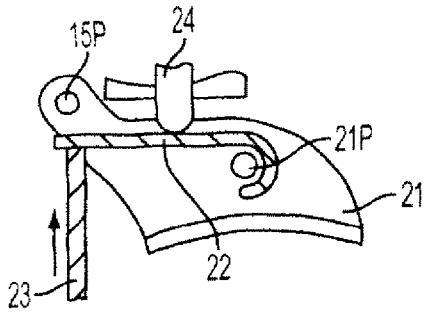
Figure 2C:
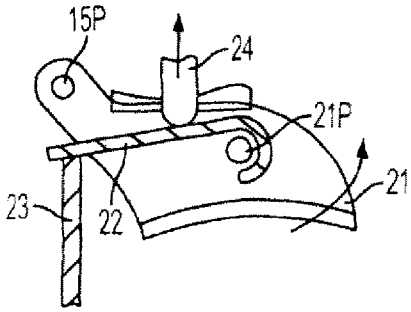

FIGS. 2A-2C show the sequence for triggering valve 24. FIG. 2A is the initial state, where valve 24 is not triggered, and the contact trip 23 and main trigger 21 are not activated. In FIG. 2B, contact trip 23 has been activated, i.e., the user has pushed fastener tool 10 unto a workpiece (not shown). At this time, valve 24 has not been triggered yet. In FIG. 2C, valve 24 is triggered when main trigger 21 is activated by rotating the main trigger 21 about pin 15P. Persons skilled in the art will recognize that the valve 24 was triggered because the contact trip 23 pushed the supplemental trigger 22 closer to valve 24, and main trigger 21 then moved the supplemental trigger 22 closer to (thus triggering) valve 24.

Persons skilled in the art should recognize that valve 24 would have been triggered regardless of the sequence of activation of either the contract trip 23 or main trigger 21. In other words, valve 24 would have been triggered where contact trip 23 was activated prior to activation of trigger 21, or vice versa. Valve 24 also would have been triggered if contact trip 23 and main trigger 21 were activated simultaneously. Persons skilled in the art will recognize that this trigger thus allows for a "bump mode." In other words, the user will be able to activate the driving mechanism by activating main trigger 21 and holding main trigger 21 in the activated position, while activating and deactivating contact trip 23, i.e. bumping fastener tool 10 multiple times onto workpiece W.

FIG. 3 shows an alternate trigger assembly 20'. The teachings of the previous embodiment are wholly incorporated herein by reference. In FIG. 3, like numerals refer to like parts. Persons skilled in the art should recognize FIG. 3 illustrates a "sequential" trigger assembly 20'. In other words, the trigger assembly 20' will only activate valve 24 if the contact trip 23 and main trigger 21 are activated in a specific sequence.

Figure 3A:
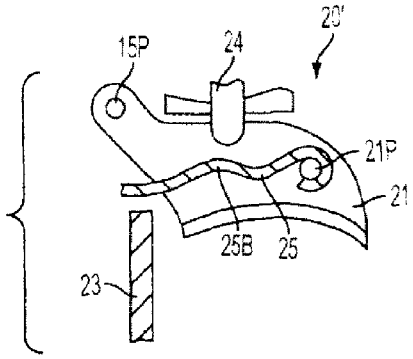
FIG. 3 is a partial cross-sectional view of a second trigger assembly, where FIGS. 3A, 3B, 3C, ad 3D show different states of the triggering sequence.
Figure 3B:
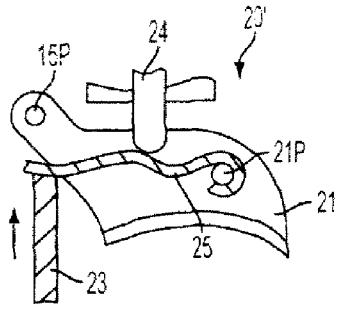
Figure 3C:
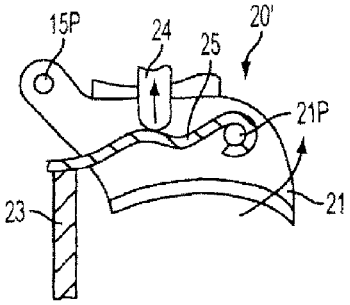

FIG. 3A shows the trigger assembly 20' in the deactivated mode where neither contact trip 23 or main trigger 21 have been activated. FIG. 3B shows activation of contact trip 23, thus moving supplemental trigger 25, which is pivotally attached to main trigger 21 via pin 21P. FIG. 3C shows activation of valve 24, when contact trip 23 and main trigger 21 are activated. Persons skilled in the art should recognize that contact trip 23 moves supplemental trigger 25 closer to valve 24, and main trigger 21 triggered valve 24 via supplemental trigger 25 when it was pivoted about pin 15P.

Figure 3D:
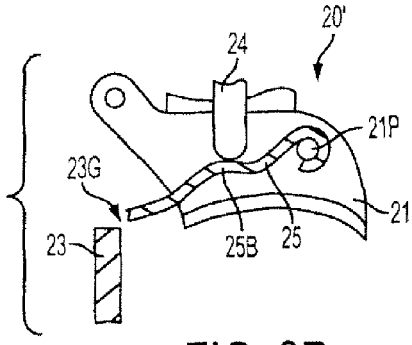

FIG. 3D shows the state of the trigger assembly 20' when main trigger 21 is kept activated in the activated position, but contact trip 23 has been returned to the deactivated position. Persons skilled in the art should note that bump 25B on supplemental trigger 25 maintains valve 24 in the activated position. In other words, valve 24 has not been allowed to go back to its original position to reset. Accordingly, in a pneumatic system, the piston (not shown) would not return to its original position until main trigger 21, supplemental trigger 25 and valve 24 are allowed to return to their original deactivated position.

Persons skilled in the art will recognize that, if the user maintains the main trigger 21 in the activated position, the user will not be able to reactivate valve 24 when contact trip 23 is activated. This is because contact trip 23 will not contact supplemental trigger 25 as a gap 23G is created therebetween.

Similarly, persons skilled in the art will recognize that contact trip 23 will not contact supplemental trigger 25 if trigger assembly 20' is activated in the wrong sequence. In other words, if the user activates main trigger 21 and then activates contact trip 23, the user will not be able to trigger valve 24 and thus fail to activate fastener tool 10.

Persons skilled in the art will recognize that it is preferable to provide a fastener tool 10 with one of the trigger assemblies 20 or 20'. If the user prefers a specific mode, i.e., bump mode over sequential mode, the user can then replace the installed trigger assembly with the desired trigger assembly. It is also preferable to construct trigger assemblies 20 and 20' with the same common parts, except for supplemental trigger 22 or 25. In other words, in both trigger assemblies 20, 20' sold to the user, the main trigger 21 and contact trip 23, etc. will be the same. This reduces manufacturing costs, etc.

Figure 4A:
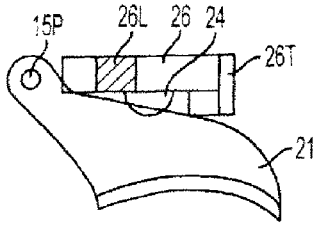
FIG. 4A shows the trigger in the locked-out position and FIG. 4B shows the trigger in the unlocked position.
Figure 4B:
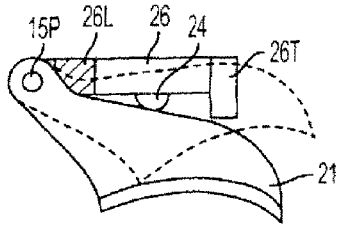

FIG. 4 illustrates a trigger lock mechanism 26 for preventing undesired triggering of main trigger 21. Trigger lock 26 may be pivotally attached around valve 24 so that it pivots about valve 24. Preferably, trigger lock 26 is substantially shaped like a ring. Trigger lock 26 may have at least one protrusion, including lock 26L. This lock 26L may be moved between locking position (as shown in FIG. 4A) and bypassed position (as shown in FIG. 4B). When trigger lock 26 is rotated towards the locking position, lock 26L will be disposed between trigger 21 and housing 15 and/or handle 11. Accordingly, if a user attempts to activate main trigger 21, trigger 21 will contact lock 26L and not move the necessary distance to activate valve 24.

On the other hand, if trigger lock 26 is rotated to the bypassing position, main trigger 21 will not contact lock 26L, thus allowing trigger 21 to activate valve 24.

It may also be preferable to provide trigger lock 26 with protrusion 26T to facilitate the rotation of trigger lock 26. Such protrusion 26T preferably has some texture thereon to provide a good finger grip for rotating the trigger lock 26 with his or her fingers.

Figure 5A:
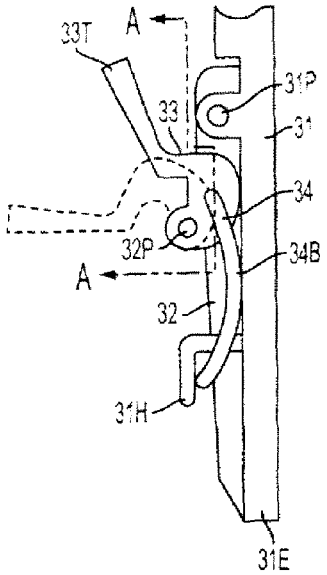
FIG. 5A (PRIOR ART)
FIG. 5A is a side view of the nosepiece assembly and FIG. 5B is a rear view along line A-A of FIG. 5A.
Figure 5B:
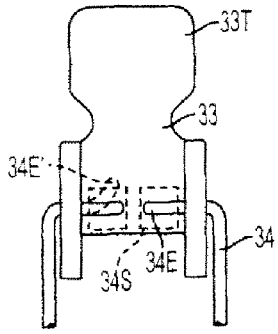
FIG. 5B (PRIOR ART)
Figure 6:
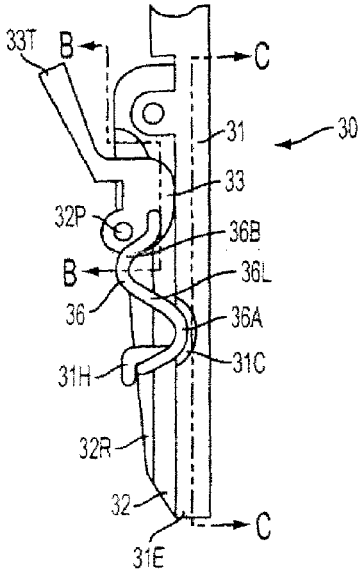
FIG. 6 illustrates a first embodiment of a nosepiece assembly according to the invention.

FIGS. 5A and 5B show a prior art nosepiece 31 and nosepiece cover 32 rotatably attached to nosepiece 31 via a pin 31P. To lock the nosepiece cover 32 in place, hooks 31H are provided on nosepiece 31 and a latch 33 is pivotally attached to nosepiece cover 32 via pin 32P. Latch 33 may have a tab 33T for allowing the user to move the latch between the locked and unlocked positions. Latch 33 also carries a spring 34, which is typically made of wire. The spring 34 has one bend 34B between hook 31H and latch 33. Nosepiece cover 32 contacts the underside of spring 34 at the hook area. The spring 34 is inserted into latch 33 by ears 34E, which are oriented perpendicular to the longitudinal axis of nosepiece 31. Over time, ears 34E bend away from the end of 31E of nosepiece 31 (shown as 34E' in broken lines). Also, the wear on latch 33 and ears 34E is accelerated because of the high loads placed on and/or because of the relative motion of the spring 34. This contributes to a loss of force in spring 34, thus allowing the nosepiece cover 32 to open slightly during firing, and increasing the possibility of a nail jamming between nosepiece 31 and cover 32. In another embodiment, swages 34S (shown in broken lines in FIG. 5A) are coupled to ears 34E. However, this is a difficult and expensive manufacturing process and may not ultimately prevent bending of the ears 34E.

FIGS. 6-8C illustrate a nosepiece assembly 30, where like numerals shown in FIGS. 5A and 5B refer to like parts. Spring 36 includes a pair of side legs 36L, each of which is disposed between hook 31H and latch 33, connected at one end by a cross-bar 36CB that extends across and transverse to nosepiece cover 32 (see also FIG. 8B). Unlike the nosepiece assembly of FIGS. 5A and 5B, each side leg 36L of spring 36 has at least two bends 36A and 36B, e.g., with one bend on each side of nosepiece assembly 30 to form an S-shape. In addition, nosepiece 31 has cutout 31C for allowing bend 36A to extend beyond or below the top surface of the nosepiece cover 32. By providing spring 36 with at least two bends in an S-shape, load stress concentrations on spring 36 are reduced.

The cross-bar 36CL of spring 36 may also have a third bend 36C, which follows the contour of nosepiece cover 32, where bend 36C follows the shape of a rib 32R on nosepiece cover 32. Persons skilled in the art will recognize that having spring 36 follow the contour of nosepiece cover 32 will not obstruct the user's sight of the operation. By keeping the spring 36 relatively close to the door, it also reduces the risk of damage to the spring 36 if the fastener tool 10 is accidentally dropped.

In addition, the ends 36E of spring 36 may be inserted into latch 33 and bent downwardly toward nosepiece end 31E. Persons skilled in the art should recognize that end 36E may be bent prior to insertion into latch 33. Such feature facilities assembly and obviates the need for a swaging operation.

Figure 7:
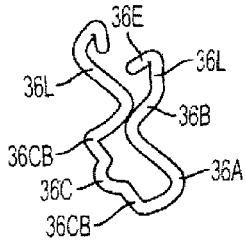
FIG. 7 is a perspective view of the latch wire according to the invention.
Figure 8:
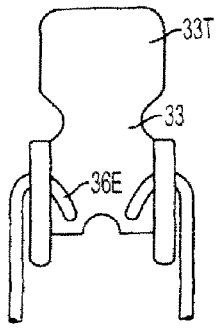
FIG. 8 is a rear view of the latch assembly along line B-B of FIG. 6.
Figure 8A:
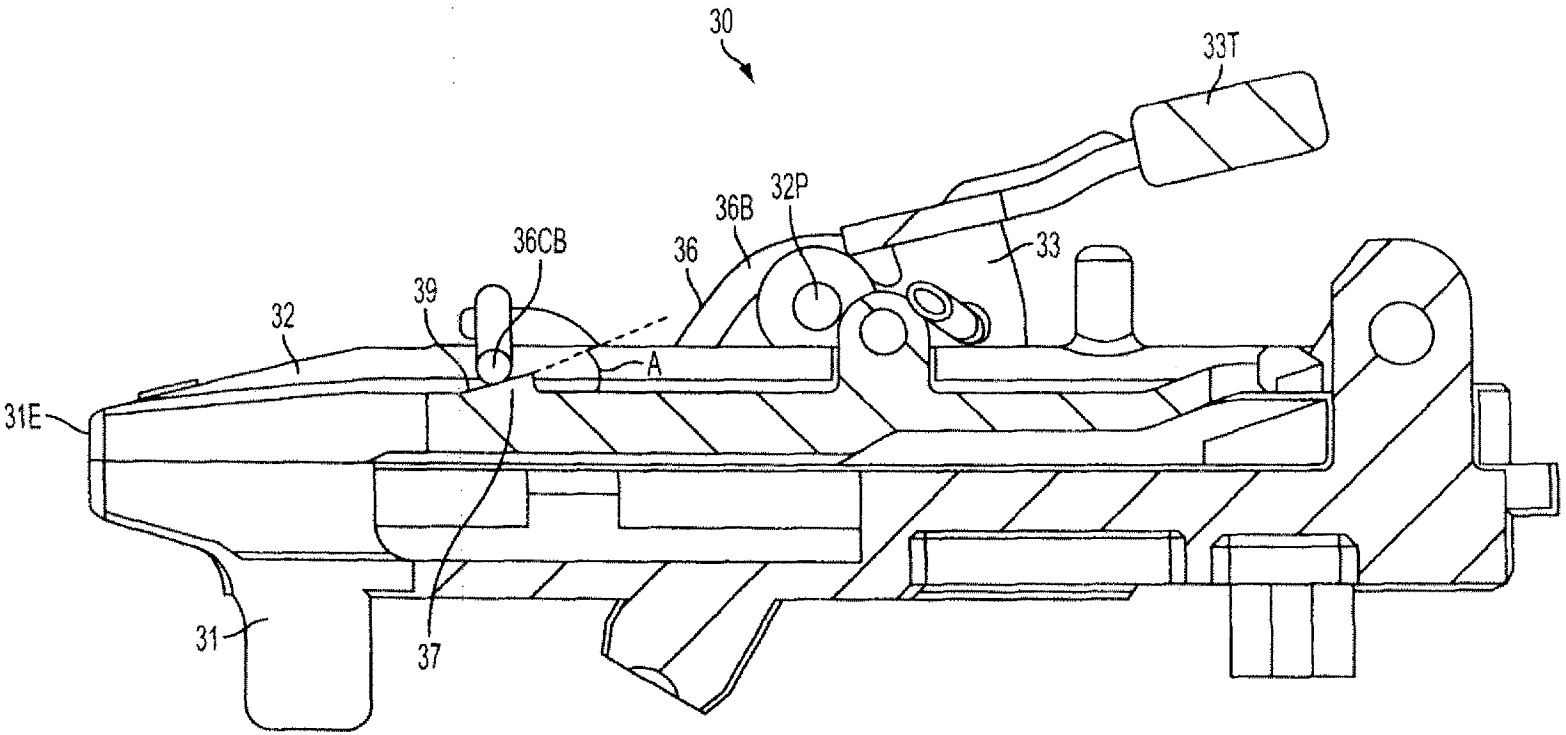
FIG. 8A is a cross-sectional view of a second embodiment of a nosepiece assembly.
Figure 8B:
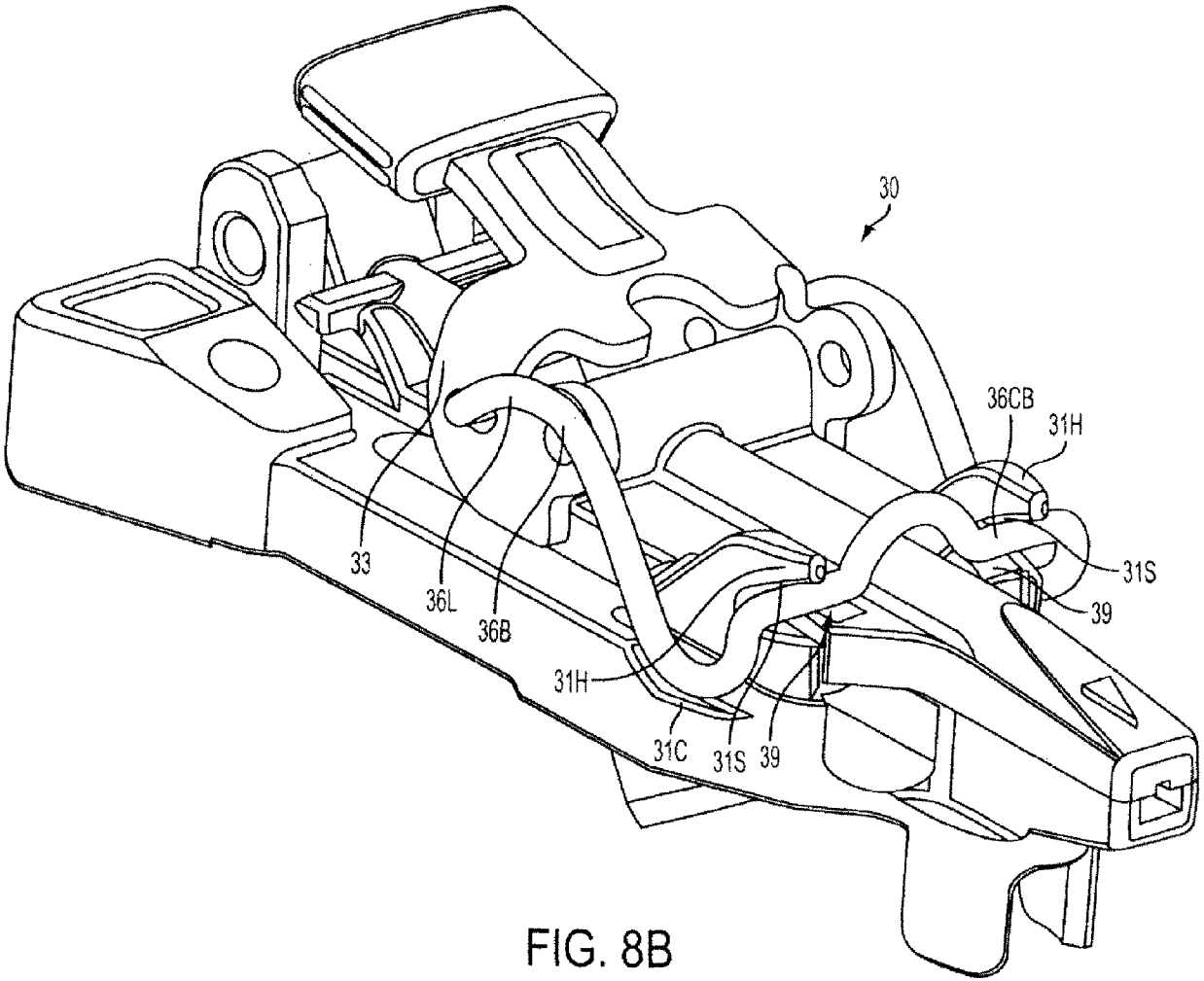
FIGS. 8B and 8C are perspective views of the nosepiece assembly of FIG. 8A shown in the closed and open positions, respectively.
Figure 8C:
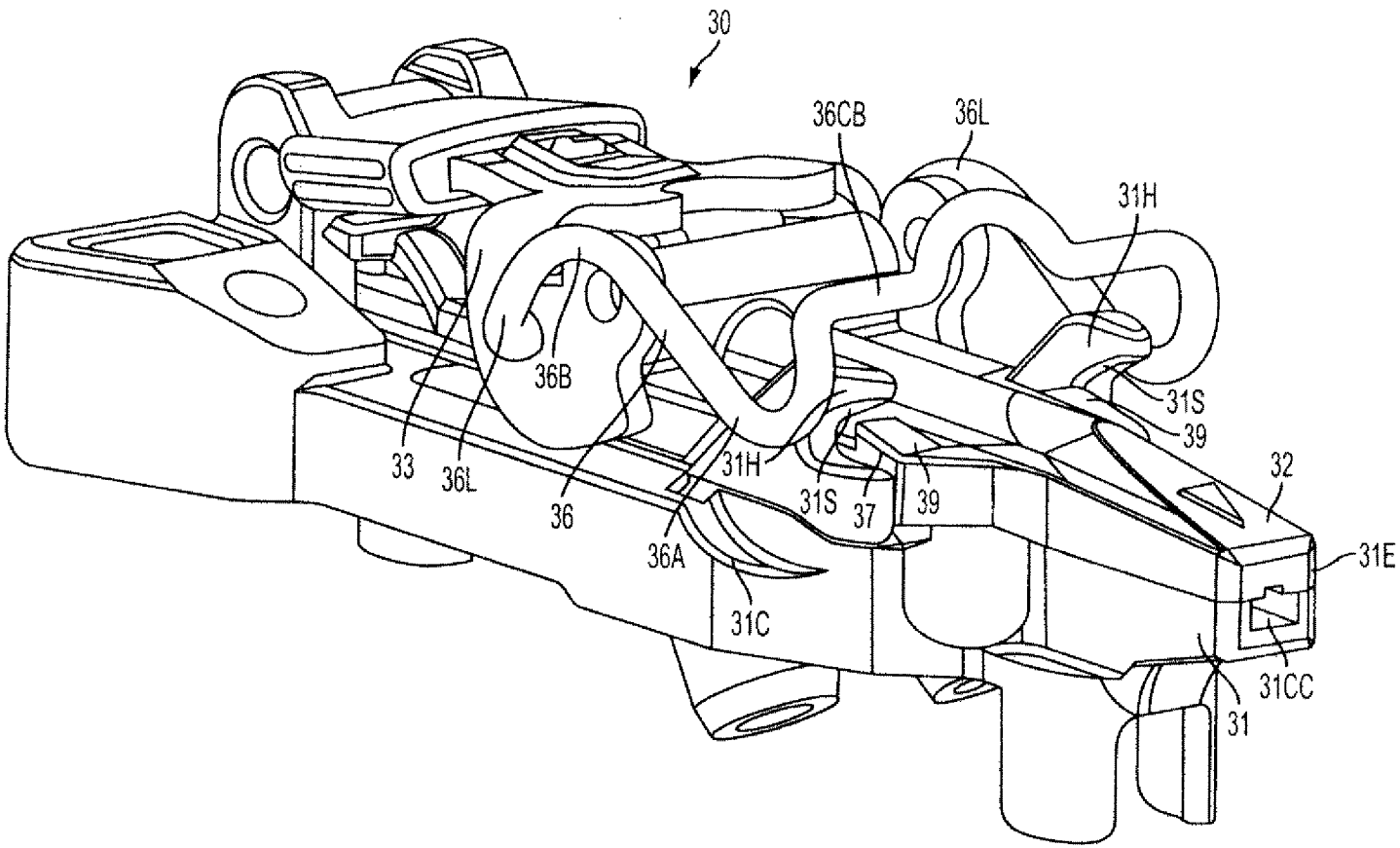

FIGS. 8A-8C illustrate a modified embodiment of the nosepiece assembly 30 shown in FIGS. 7-8, where like reference numerals refer to like parts. FIG. 8A shows a cross-sectional view of the latch 33 and spring 36 in the closed position. FIGS. 8B and 8C show perspective views of the latch 33 and spring 36 in the closed and open positions, respectively. The nosepiece cover 32 includes a pair of lugs 37, each having a ramped surface 39 that is adjacent to and facing a top inside surface 31S of one of the hooks 31H. Each ramped surface 39 is angled to extend upward from the nosepiece cover 32 away from the front 31F of the nosepiece 31. The approximate angle A of the ramped surface relative to horizontal is between approximately 5 degrees and approximately 30 degrees (e.g., approximately 14 degrees). The cross-bar 36CB of the spring 34 is received between the ramped surfaces 39 and the top inside surfaces 31S of the hooks 31H. The ramped surfaces 39 cam the cross-bar 36CB toward the top inside surfaces 31S of the hooks 31H. This serves, e.g., to reduce the precision with which the spring and 36 and nosepiece cover 32 must be manufactured to properly mate with each other, which in turn reduces manufacturing time and cost. In addition, the camming action of the ramped surfaces 39 increase the tightness of the locking of the latch 33 and spring 36. It should be apparent to one of ordinary skill in the art that the lugs 37 and ramped surfaces 39 can be used with latches and/or springs other than the latch 33 and S-shaped spring 36 shown in FIGS. 6-8B. For example, the lugs 37 and ramped surfaces 39 can be used with the latch 33 and C-shaped spring 34 shown in FIGS. 5A-5B.

Figure 9:
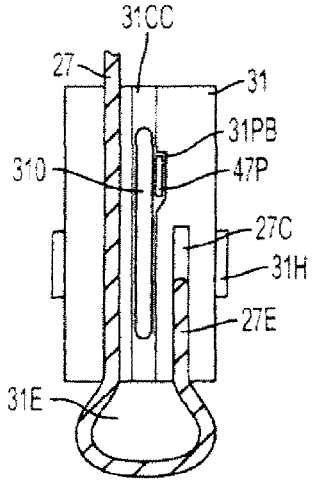
FIG. 9 is a partial front view of a nosepiece assembly along line C-C of FIG. 6.
Figure 10:
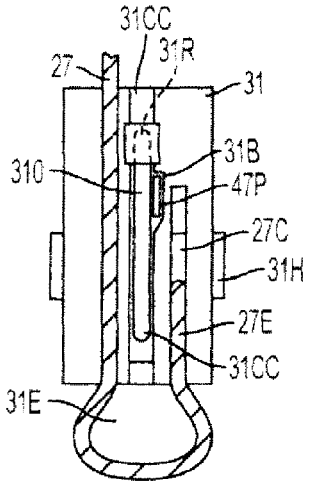
FIG. 10 is a partial front view of an alternate nosepiece assembly along line C-C of FIG. 6.

FIGS. 9 and 10 illustrate the inside of nosepiece 31, where like numerals refer to like parts. As shown in FIGS. 9 and 10, contact trip 27 extends through nosepiece 31 until it extends beyond the end 31E of nosepiece 31. The end 27E curves back and extends into nosepiece 31. Nosepiece 31 preferably has a channel 27C for allowing movement of contact trip 27 along such channel when the fastener tool 10 is depressed onto workpiece W. Nosepiece 31 may have a channel 31CC for allowing the driver element in the driving mechanism to extend therethrough and push a nail out towards the end 31E. Nails may be introduced into channel 31CC via opening 31O.

As shown in FIG. 10, it may be preferable to provide a retainer 31R onto channel 31CC. Such retainer 31R prevents the nail which enters channel 31CC from moving beyond channel 31CC, for example, when nosepiece cover 32 is open.

Referring to FIGS. 1 and 11-13, lower contact trip 27 is connected to contact trip 23. Typically, contact trip 27 has a bent wire that wraps around the front of nosepiece assembly 30. Such arrangement obstructs the view of the contact between the nosepiece assembly 30 and the workpiece W. Typically, such wire forms are also substantially flat, so when the fastener tool 10 is angled with respect to the work, the nail or staple is not fully introduced into the workpiece W, thus leaving an exposed head.

The improved contact trip 27 resolves such problems by providing lower portion 27R, which extends downwardly along the sides of the nosepiece and forwardly away from magazine assembly 40, extending beyond nosepiece cover 32. Lower portion 27R then extends rearward in a curve towards magazine assembly 40 and wrap around the rear of nosepiece assembly 30. Persons skilled in the art will recognize that such arrangement provides a sight line S which allows the user to see the contact between the nosepiece assembly 30 and workpiece W.

Figure 11:
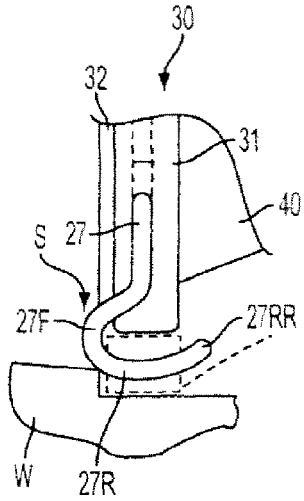
FIGS. 11, 12 and 13 show an improved contact trip according to the invention being used with different workpieces.

Preferably, lower portion 27 is rounded, rather than flat. Accordingly, the fastener tool 10 will be triggered equally well when used with complex molding. As shown in FIG. 11, the front portion 27F of portion 27R will activate contact trip 27 when it contacts workpiece W. In other words, contact trip 27 will be activated when fastener tool 10 is disposed on molding from the inside of the molding.

Figure 12:
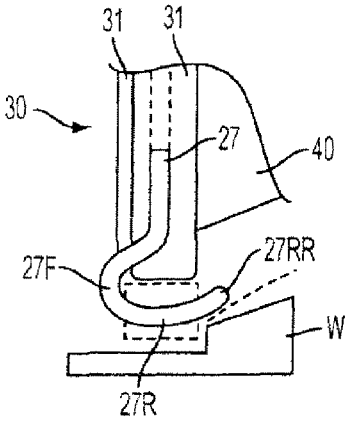
Figure 13:
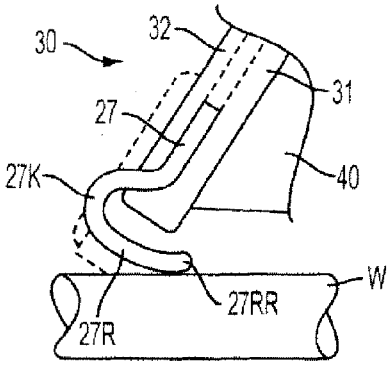

Similarly, a rear portion 27RR of portion 27R will activate contact trip 27 when the fastener tool 10 is disposed on a complex molding and fastener tool is contacting the workpiece from the outside of the trim as shown in FIG. 12. Finally, as shown in FIG. 13, having a rounded portion 27R allows trigger activation of contact trip 27 regardless of the angle of contact between the fastener tool 10 and workpiece W.

Figure 14:
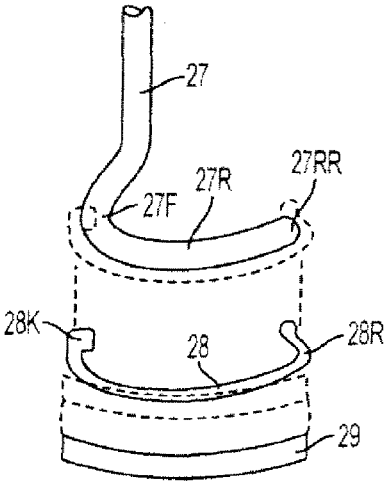
FIG. 14 shows a no mar pad assembly for the contact trip according to the invention.

FIG. 14 illustrates no mar assembly on contact trip 27. The no mar assembly comprises piece 28, which is preferably stamped and bent so that it clamps onto rounded portion 27R of contact trip 27. Preferably, piece 28 is made of sheet metal. As shown in FIG. 14, piece 28 may have rear hook 28R for hooking onto the rear portion 27K. Similarly, piece 28 may have front hooks 28F for latching onto the front portion 27F of contact trip 27. Persons skilled in the art shall recognize that there are two front hooks 28F. It may also be preferable to apply a band 29 onto piece 28. Preferably, band 29 is bonded to the bottom and sides of piece 28 to protect the workpiece W from the rounded portion 27R when the fastener tool 10 is depressed onto workpiece W. Preferably band 29 is made of polyurethane.

Figure 15B:
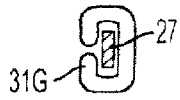
FIG. 15B is a partial cross-sectional view along line A-A of FIG. 15A.
Figure 15A:
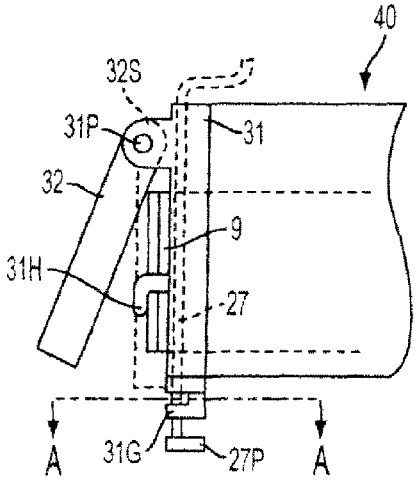
FIG. 15A is a side view of the nosepiece assembly.

FIGS. 15A-15B show an alternate nail retainer mechanism, where like numerals refer to like parts. In this embodiment, nosepiece cover 32 is provided with a stop 32S thereon. Said stop 32S contacts nosepiece 31 when nosepiece cover 32 is rotated to provide access into nosepiece 31. When nosepiece cover 32 is rotated, stop 32S approaches nosepiece 31 until contact is achieved. When contact exists between stop 32S and nosepiece 31, nosepiece cover 32 cannot rotate any further. Stop 32S may prevent movement of nosepiece cover 32 beyond 90 degrees off nosepiece 31. Preferably, the maximum angle between nosepiece 31 and nosepiece cover 32 is equal to or less than about 45 degrees. Because nosepiece 32 cannot rotate any further, nails 9, which may be moving out towards nosepiece cover 32 will not be able to move forwardly beyond nosepiece cover 32. In other words, nails 9 have been retained between nosepiece cover 32 and nosepiece 31. Persons skilled in the art should recognize that it is preferable to provide a reference 31R as shown in FIG. 10 in addition to the stop 32S.

Preferably, nosepiece 31 may have a retainer 31G, which receives contact trip 27 therethrough and substantially surrounds contact trip 27. Preferably, retainer 31G has a substantially C-shaped cross-section. Retainer 31G minimizes movement of contact trip 27 along any direction other than vertically.

Figure 16A:
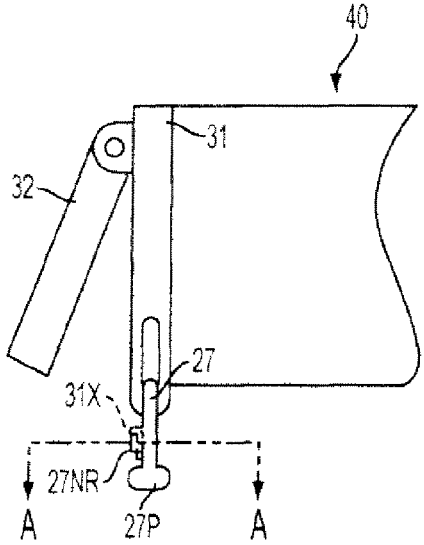
FIG. 16A is a side view of the nosepiece assembly.
Figure 16B:
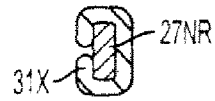
FIG. 16B is a cross-section along line A-A of FIG. 16A.

FIGS. 16A-16B show another nosepiece assembly, where like numerals refer to like parts. In this embodiment, contact trip 27 has a retainer 27NR, which receives nosepiece protrusion 31X theretrough, and substantially surrounds nosepiece protrusion 31X. Preferably, retainer 27NR has a substantially C-shaped cross-section. Retainer 27NR minimizes movement of contact trip 27 along any direction other than vertically. This is because retainer 27NR forces contact trip 27 to slide along nosepiece protrusion 31X.

An alternate embodiment of contact trip 27 is shown in FIG. 15. In this embodiment, the contact trip 27 has a portion 27P which may comprise of polymer such as polyurethane, or rubber molded over contact trip 27. Persons skilled in the art will recognize that such structure will provide an alternate no mar pad as discussed before.

Figure 17:
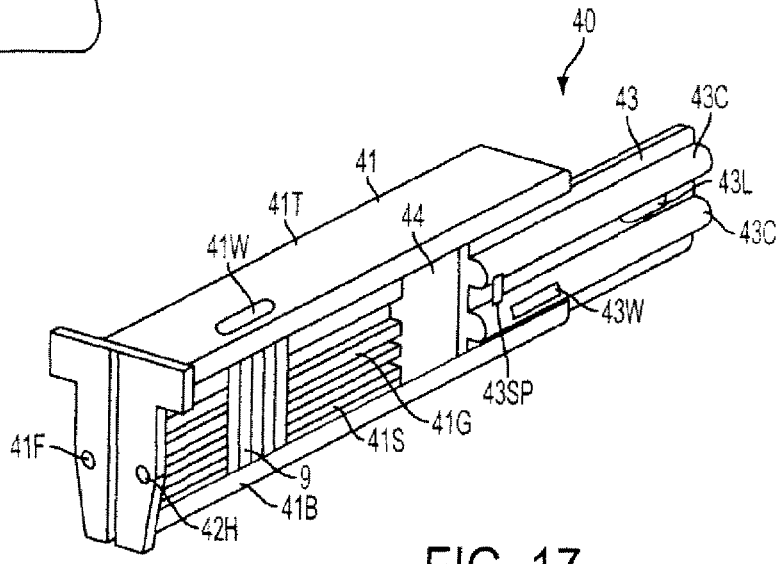
FIG. 17 is a perspective view of a first embodiment of a magazine assembly according to the invention.
Figure 18:
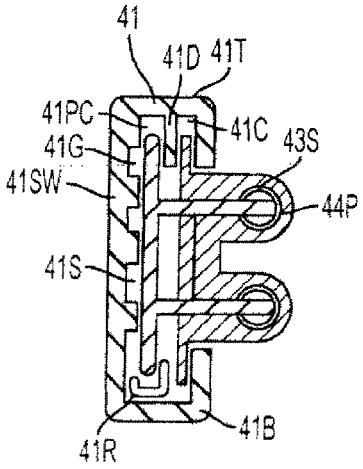
FIG. 18 is a partial cross-sectional view along plane A-A-A of FIG. 17.
Figure 19:
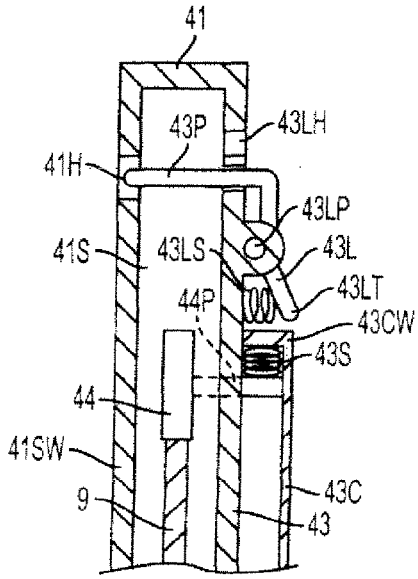
FIG. 19 is a partial cross-sectional view of the magazine assembly of FIG. 17.

FIGS. 17-19 illustrate a first embodiment of magazine assembly 40. Magazine assembly 40 comprises extrusion 41, which is substantially C-shaped. Persons skilled in the art should recognize that extrusion 41 is preferably made of plastic and/or metal, etc.

Extrusion 41 may have a substantially horizontal top wall 41P, a substantially horizontal bottom wall 41B, and a nail loading space 41S defined between the top and bottom walls 41P, 41B for loading nails 9 therein. Persons skilled in the art should recognize that nail loading space 41S preferably has grooves 41G for engaging the heads of nails 9. Persons skilled in the art shall recognize that grooves 41G are disposed at different heights along space 41S to engage nails 9 having different heights.

Magazine assembly 40 also has a sliding door 43 moveable between the top and bottom walls 41P, 41B. Extrusion 41 may have a divider rail 41D extending downwardly from top wall 41P. In addition, extrusion 41 may have a rail 41R extending upwardly from bottom wall 41B. Rail 41R is preferably made of metal, such as steel, etc. Rail 41R is preferably disposed under the nails 9 to prevent nails 9 from scratching bottom wall 41B.

Persons skilled in the art will recognize that rails 41B, 41R extend into nail loading space 41S. Persons skilled in the art will also recognize that rail 41D is preferably part of the extrusion 41. Persons skilled in the art should also recognize that rail 41R may be provided on the top of nail loading space 41S, while rail 41D may be provided on the bottom of nail loading space 418.

Rails 41D, 41R preferably divide the nail loading space 41S into two channels: the pusher channel 41PC and door channel 41C. Pusher channel 41PC is closest to the side wall 41SW. Nails 9 and pusher 44 preferably slide along channel 41PC. Door channel 41C slidingly receives door 43.

Figure 20A:
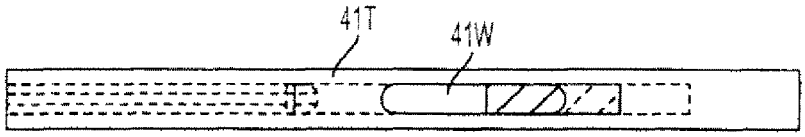
FIG. 20A is a top view of the magazine of FIG. 17
Figure 20B:
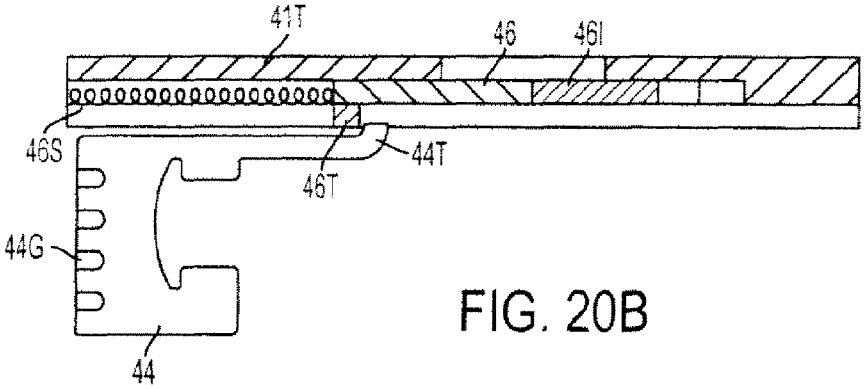
FIG. 20B is a partial cross-sectional view thereof.
Figure 21:
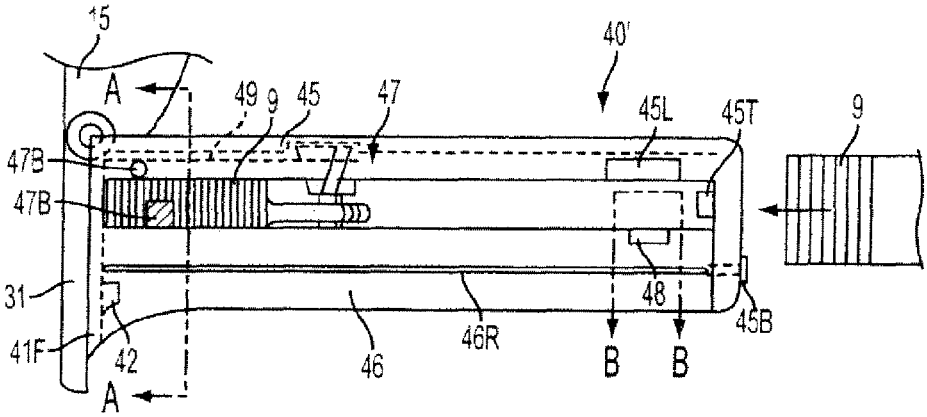
FIG. 21 is a second magazine assembly according to the invention.
Figure 22:
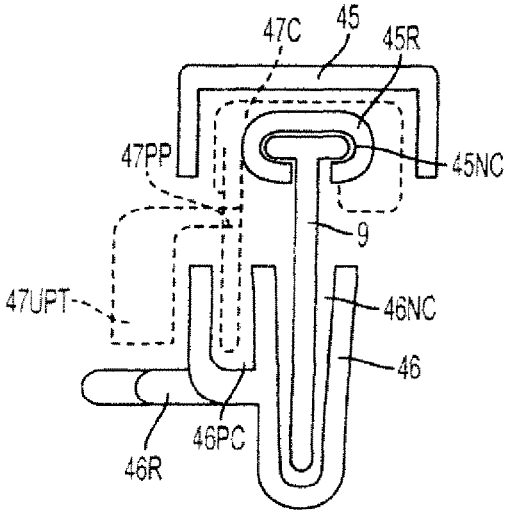
FIG. 22 is a partial cross-sectional view along line A-A of FIG. 21.
Figure 23:
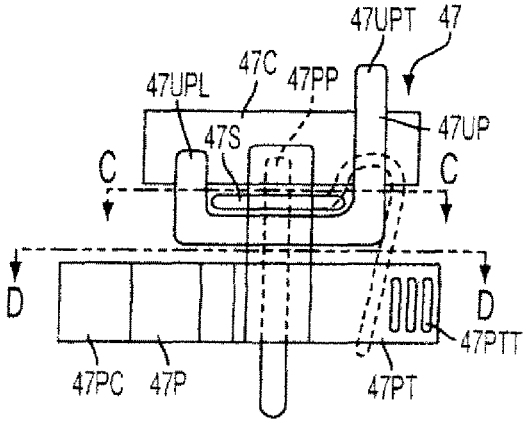
FIG. 23 is a side view of the pusher assembly of the magazine assembly of FIG. 21.
Figure 24:
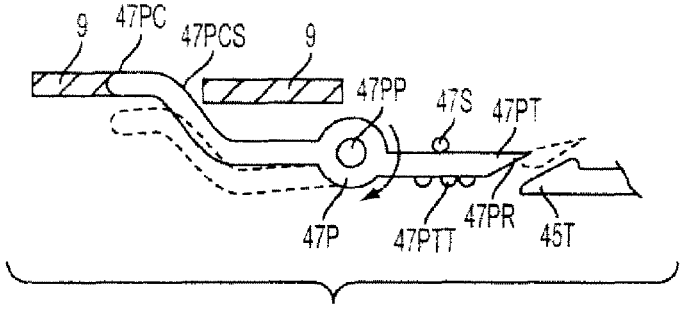
FIG. 24 is a top view along line D-D) of FIG. 23.
Figure 25:
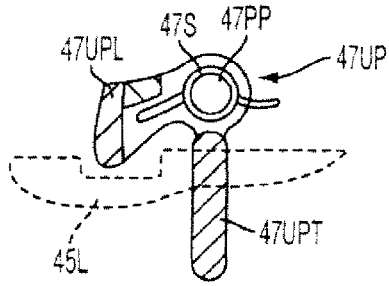
FIG. 25 is a partial cross-sectional view along line C-C of FIG. 23.
Figure 26:
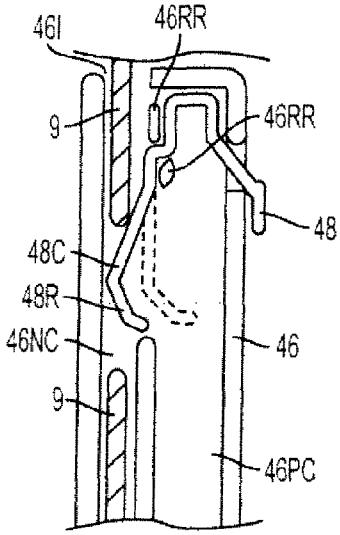
FIG. 26 is a partial cross-sectional view of the magazine assembly along line B-B in FIG. 21.

As mentioned above, a pusher 44 is slidingly disposed in pusher channel 41PC for pushing nails 9. Pusher 44 may have protrusions 44G that ride along grooves 41G (see FIG. 20A). Pusher 44 is preferably biased towards the front of the magazine assembly 40. Pusher 44 may be biased accordingly by providing pusher 44 with protrusions 44P, which extend through sliding door 43 into at least one cylinder 43C of door 43. A spring 43 is disposed in cylinder 43C and trapped between protrusion 44P and the back wall 43CW of cylinder 43C.

To prevent pusher 44 from extending into nosepiece 31, door 43 may be provided with a stop pin 438P for contacting protrusions 44P. Persons skilled in the art shall recognize that the stop pin 43SP can be disposed anywhere along the length of cylinder 43C. It is nevertheless preferable to dispose stop pin 43SP in a position where it stops pusher 44 prior to entering nose piece 31.

Protrusion 44P may have a colored portion. As the pusher 44 moves towards the front of magazine assembly 40, the colored portion will appear through window 43W disposed or cylinder 43C. This alerts the user that number of nails 9 disposed within nail loading space 41S is low.

As mentioned above, door 43 is slidingly disposed with magazine assembly 40. If a user wants to load nails within space 41S the user needs to retract sliding door 43 rearward, exposing space 41S. The user then disposes nails 9 therein, and closes the door 43C. It is preferable to provide a lock 43L on door 43 to fix the position of sliding door 43 relative to extrusion 41. Such lock 43L is preferably pivotally attached to door 43 via pin 43LP. Lock 43L may have a protrusion 43P which extends through the nail loading space 41S and engages a hole 41H on side wall 41SW, thus locking door 43.

In addition, lock 43L may have a tab 43LP for actuating the lock 43L. Preferably, a spring 43LS is disposed to bias lock 43L towards the locking position. Persons skilled in the art may recognize that spring 43LS may be disposed between tab 43LP and 43L to bias the lock 43L towards the locking position.

A second low nail indicator may be provided in magazine assembly 40. Referring to FIGS. 17-20, it is preferable to provide a window 41W in top wall 41P. An indicator 46 may slide under top wall 41P. Preferably, indicator 46 has a colored portion 46I to denote a low nail condition. Indicator 46 may have a tab 46T that engages tab 44T of pusher 44. Preferably, indicator 46 is biased towards the rear of magazine assembly 40 by the spring 46S. Accordingly, as pusher 44 travels towards nosepiece 31, pusher 44 slides indicator 46 towards the front of magazine assembly 40 via the connection between tabs 44T, 46T. As the pusher 44 gets closer to nosepiece 31, the colored portion 46I will be visible though window 41W, informing the user that the number of nails within space 41S is low.

Persons skilled in the art shall recognize that magazine assembly 40 is preferably fixedly attached to nose piece 31 via screws 42 as shown in FIG. 1. Screws 42 extend through front wall 41S via holes 42H.

Referring to FIGS. 21-26 illustrate an alternate magazine assembly 40' may comprise an upper magazine 45 and a lower magazine 46 fixedly attached to upper magazine 45 via screws 45B. Magazine assembly 40' may be attached to nose piece 31 via screws 42 extending through front wall 41F.

Upper magazine 45 is molded and may be made of plastic or metal. Lower magazine 46 may also be molded and preferably made from metal or plastic, etc.

Upper magazine 45 may have rail 45R connected thereto. Rail 45R is preferably C-shaped and receives the heads of nails 9 within channel 45NC. Preferably rail 45R is made of metal.

Lower magazine 46 preferably has two channels: nail channel 46NC, which is preferably aligned with channel 45NC, and pusher channel 46PC. Lower magazine 46 may also have at least one rib 46R for strengthening lower magazine 46.

Pusher assembly 47 may have a carriage 47C which slides along rail 45R. Carriage 47C is preferably biased towards the front of magazine assembly 40' via a leaf spring 49 disposed in nosepiece 31, housing 15 or magazine assembly 40'. Carriage 47C may have a pin 47PP which preferably extends downwardly into channel 46PC.

Upper pusher 47UP may be pivotally attached to pin 47PP. Preferably, a spring 47S is disposed around pin 47PP. One end of the spring 47S contacts upper pusher 47UP for biasing the upper pusher 47UP towards the nail channel 46NC. Upper pusher 47UP may also have a tab 47UPP for allowing the user to rotate upper pusher 47UP, as well as move the pusher assembly 47 along rail 45R.

Lower pusher 47P may be provided underneath upper pusher 47UP. Preferably, lower pusher 47P is pivotally attached to pin 47PP. Lower pusher 47P may also be biased towards nail channel 46NC by the spring 47S.

Persons skilled in the art shall recognize that lower pusher 47P has contact surface 47PC for contacting nails 9 and pushing nails 9 toward nosepiece 31.

Lower pusher 47P may also have a camming surface 47PCS, which is preferably behind contact surface 47PC. If the user introduces nails 9 into magazine assembly 40' through input 461, nails 9 will travel along channel 46NC until they contact camming surface 47PCS. The user then retracts pusher assembly 47 rearward by pulling on tab 47UPT. As the pusher assembly 47 is traveling rearward, camming surface 47PCS will slide along nails 9 and pivot lower pusher 47P about pin 47PP to bypass nails 9. Persons skilled in the art will recognize that lower pusher 47P will have at least one surface contacting the nails 9 as it travels rearward. When the rearmost nails 9 is bypassed, the spring 47S will force lower pusher 47P back into nail channel 46NC and into contact with the rearmost nail 9, thus once again biasing the nails 9 towards nosepiece 31 when the user releases or lets go of the upper pusher 47UP.

A magazine assembly 40' may have a nail retainer 48 which retains nails 9 within channel 46NC even if the nails 9 have not yet been bypassed by pusher assembly 47. Retainer 48 may be a resilient piece, preferably made of metal. Retainer 48 preferably has a camming surface 48C facing the rear of magazine 40', and a retaining surface 48R facing the front of magazine 40'. Accordingly, as nails 9 are introduced into magazine assembly 40' via the input 46I, the nails 9 will move along surface 48C, push retainer 48 towards pusher channel 46PC, and when the rearmost nail has bypassed retainer 48, retainer 48 will snap back into channel 46NC. The nails will not be able to exit the channel 46NC via the input 461 because of the retainer surface 48R. Preferably, retainer 48 is held in place via two bosses 46RR disposed on lower magazine 46. Another end of retainer 48 may be anchored and extend through a wall of lower magazine 46.

Lower magazine 46 may have protrusion 47B, which contacts lower pusher 47P as it moves towards the front of magazine assembly 40', causing contact surface 47PC to move into channel 46PC. Preferably, protrusion 47B is placed so that pusher 47P is rotated prior to contact surface 47PC entering nosepiece 31 and channel 31CC. Preferably, nosepiece 31 may have pusher bypass area 31PB for allowing pusher 47P to move laterally and avoid contact with the driver mechanism (see FIGS. 9 and 10). Persons skilled in the art will recognize that a user may push tab 47PT to move contact surface 47PC into bypass area 31PB.

Lower pusher 47P may have a tab 47PT, which may be pushed by the user to move the contact surface 47PC into channel 46PC. Tab 47PT may have a ramp 47PR that will contact tab 45T disposed on the rear of magazine assembly 40', when lower pusher 47P is moved rearward and reaches the rear of magazine assembly 40'. As ramp 47PR moves along tab 45T, lower pusher 47P will pivot, moving contact surface 47PC into channel 46PC, allowing nails 9 to move into channel 46NC.

Alternatively, tab 47PT may have protrusions 47PPT which engage tab 45T disposed on the rear of magazine assembly 40'. Accordingly, when the user moves pusher assembly 47 to the rear of magazine assembly 40', tab 45T and protrusions 47PPT engage to retain pusher assembly 47 in the rearmost position, facilitating the insertion of nails 9 into magazine assembly 40'.

Upper pusher 47 may also maintain pusher assembly 47 in a rearmost position. This can be done by providing upper magazine 45 with a lock channel 45L which receives the lock 47UPL. In order to unlock pusher assembly 47 the user would push on tab 47UPT and rotate lock 47UPL out of lock channel 45L. Preferably, rib 46R is long enough to prevent inadvertent or undesired pushing on tab 47UPT, which would thus unlock upper pusher 47UP.

Persons skilled in the art will recognize that pusher 47 allows the user to manipulate magazine assembly 40' in two manners. First, the user can insert the nails 9 into magazine assembly 40', then pull the pusher assembly 47 rearward. Lower pusher 47P would bypass nails 9 and rotate into the pushing position after the rearmost nail has been bypassed. This is commonly know as a "load and cock" operation.

Alternatively, the user can pull the pusher assembly 47 rearward and lock it in place as described above, then load nails 9, and release pusher assembly 47, where pusher 47P would then contact the rearmost nail 9. This is commonly known as a "cock and load" operation. Persons skilled in the art will also recognize that locking the pusher assembly 47 in the rear of magazine assembly 40' will facilitate loading and/or unloading of nails 9.

Figure 27A:
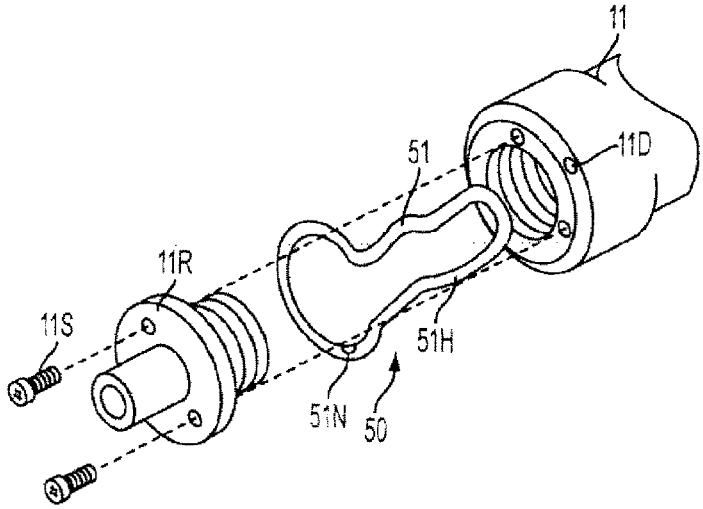
FIG. 27A is an exploded view of a first embodiment of a belt hook assembly according to the invention.
Figure 27B:
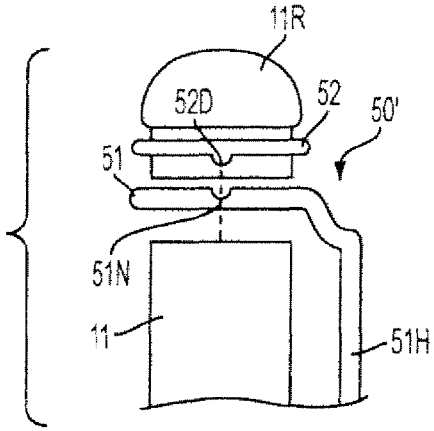
FIG. 27B is an exploded view of an alternate embodiment of a belt hook assembly.
Figure 28A:
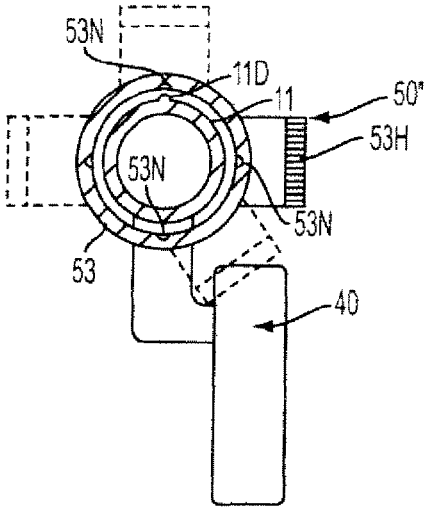
FIG. 28A is a cross-sectional view along line A-A of FIG. 1
Figure 28B:
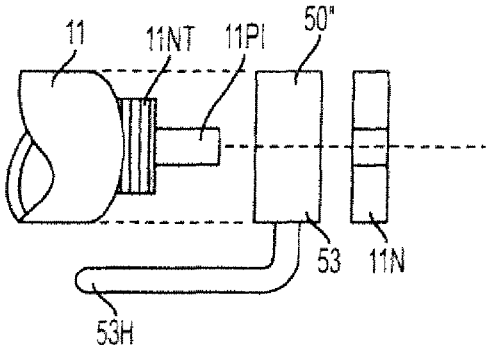
FIG. 28B is an exploded view thereof.

Referring to FIGS. 1 and 27-28, it is preferable to provide fastener tool 10 with a belt hook assembly. Referring to FIG. 27A, a belt hook assembly 50 is preferably disposed on handle 11. Belt hook assembly 50 may include belt hook 51 disposed between handle 11 and rear portion 11R. Portion 11R may be fixedly attached into handle 11 via screws 11S.

Belt hook 51 may have a hook portion 51H, which preferably extends substantially parallel to the longitudinal axis of handle 11. Belt hook 51 may be made of wire. Belt hook 51 is preferably made of a single piece of wire welded into a continuous loop. Preferably, the wire has a diameter of about 4 mm. Hook portion 51H is preferably shaped in an oblong oval shape with a rounded end to facilitate slipping the belt hook 51 onto a tool belt.

Belt hook 51 may have a notch 51N for receiving a detent protrusion 11D disposed on handle 11. Preferably, handle 11 has at least two detent protrusions 11D. Protrusions 11D and notch 51N can be disposed so that the hook 51 is movable leftward of the handle 11, rightward of the handle 11 and/or upwardly of handle 11. Persons skilled in the art will recognize that the detents protrusion 11D and notch 51N may be provided for any other desired hook positions.

FIG. 27B shows another hook assembly 50' where like numerals refer to parts. In this embodiment, detent ring 52 may be disposed between hook 51 and rear portion 11R. Ping 52 may have a detent protrusion 52D, which engages notches 51N on the hook 51. Persons skilled in the art shall recognize that ring 52 may be disposed instead between handle 11 and hook 51.

FIG. 28 shows a third belt hook assembly 50". Preferably, belt hook assembly 50" is made of plastic molded over steel. Persons skilled in the art will recognize that hook 53B may be disposed around handle 11. The handle 11 may have a protrusion 11D, which engages detent notch 53N and is disposed inside of belt hook 53. Persons skilled in the art should recognize that the detent notches 53N and protrusions 11D may be disposed to select the number of available positions for belt hook 53. As shown in FIG. 28, belt hook 53 preferably has at least four notches 53 so that the belt hook 53 can be disposed leftward, rightward, downwardly and upwardly of handle 11. Persons skilled in the an should recognize that by placing hook 53 downwardly of handle 11, the user will have placed hook 53 in a storage position.

Persons skilled in the art will recognize that protrusions 11D may extend substantially parallel to the longitudinal axis of handle 11 (as shown in FIG. 27), or substantially perpendicular to the longitudinal axis of handle 11 (as shown in FIG. 28).

Persons skilled in the art should recognize that handle 11 can be designed so that an air seal between rear-portion 11R and handle 11 must be broken in order to remove belt hook assembly 50, 50'. Alternatively, handle 11 can be designed so that no air seal is broken between handle 11 and nut 11N (see FIGS. 1 and 28B) when removing belt hook assembly 50". As show in FIG. 28B, the air input 11PI is directly connected to handle 11. Handle 11 has threads 11NT for threadingly engaging nut 11N. Belt hook assembly 50" is thus disposed between handle 11 and nut 11N without requiring an air seal therebetween.

Numerous modifications may be made to the exemplary implementations described above. These and other implementations are within the scope of the following claims.

What is claimed is:

1. A fastener tool comprising:

a housing comprising a nosepiece;

a magazine connected to the housing for storing a fastener;

a driving mechanism disposed within the housing for driving the fastener into a workpiece;

a trigger assembly pivotally attached to the housing for activating the driving mechanism;

a nosepiece cover pivotally attached to the nosepiece;

a latch pivotally attached to the nosepiece cover; and a latch wire pivotally attached to the latch for engaging at least one hook disposed on the nosepiece, wherein the latch wire has a portion extending between the latch and the hook, the portion having at least two bends.

2. The fastener tool of claim 1, wherein the nosepiece has a cutout for allowing at least one of the two bends to extend below the top surface of the nosepiece cover.

3. The fastener tool of claim 1, wherein the at least two bends in the latch wire form a substantially S-shape.

4. The fastener tool of claim 1, wherein the latch wire has a first and second legs extending along a longitudinal axis of the nosepiece and a cross bar connecting the first and second legs and extending across the nosepiece cover.

5. The fastener tool of claim 4, wherein each of the first and second legs has at least two bends.

6. The fastener tool of claim 5, wherein each of the first and second legs has an S-shape.

7. The fastener tool of claim 4, wherein the cross bar comprises a third bend.

8. The fastener tool of claim 1, wherein the latch wire comprises at least a third bend.

9. The fastener tool of claim 1, wherein the nosepiece cover further comprises a ramped surface that opposes an inner surface of the hook, wherein the latch wire is caromed by the ramped surface toward the inner surface of the hook when the latch is closed.

10. A fastener tool comprising:

a housing comprising a nosepiece;

a magazine connected to the housing for storing a fastener;

a driving mechanism disposed within the housing for driving the fastener into a workpiece;

a trigger attached to the housing for activating the driving mechanism;

a nosepiece cover pivotally attached to the nosepiece;

a latch pivotally attached to the nosepiece cover; and a spring pivotally attached to the latch for engaging at least one hook disposed on the nosepiece, wherein the spring has first and second legs extending along a longitudinal axis of the nosepiece and a cross-bar connecting the legs and extending across the nosepiece, each of the first and second legs having at least two bends.

11. The fastener tool of claim 10, wherein each of the first and second legs has an S-shape.

12. The fastener tool of claim 10, the nosepiece has a cutout for allowing at least one of the two bends to extend below the top surface of the nosepiece cover.

13. The fastener tool of claim 10, wherein the cross-bar has a bend.

14. The fastener tool of claim 10, wherein the nosepiece cover further comprises a ramped surface that opposes an inner surface of the hook, wherein the cross-bar is cammed by the ramped surface toward the inner surface of the hook when the latch is closed.

15. The fastener tool of claim 14, wherein the ramped surface is at an angle between approximately 5 degrees and approximately 30 degrees relative to the nosepiece cover.

* * * * *